US008037684B2

(12) United States Patent
Petitjean

(10) Patent No.: US 8,037,684 B2
(45) Date of Patent: Oct. 18, 2011

(54) VARIABLE FLOW TURBOCHARGER

(75) Inventor: Dominique Petitjean, Julienrupt (FR)

(73) Assignee: Honeywell International Inc., Morristown, NJ (US)

( * ) Notice: Subject to any disclaimer, the term of this patent is extended or adjusted under 35 U.S.C. 154(b) by 476 days.

(21) Appl. No.: 11/887,784

(22) PCT Filed: Apr. 4, 2005

(86) PCT No.: PCT/EP2005/003538

§ 371 (c)(1), (2), (4) Date: Nov. 7, 2008

(87) PCT Pub. No.: WO2006/105804

PCT Pub. Date: Oct. 12, 2006

(65) Prior Publication Data

US 2009/0151350 A1 Jun. 18, 2009

(51) Int. Cl.
*F02D 23/00* (2006.01)
*F01D 17/14* (2006.01)

(52) U.S. Cl. ..... 60/602; 415/126; 415/157; 415/158; 415/167

(58) Field of Classification Search ..... 60/597–612, 60/602; 415/157, 158, 126, 167
See application file for complete search history.

(56) References Cited

U.S. PATENT DOCUMENTS

| | | | | |
|---|---|---|---|---|
| 2,861,774 | A * | 11/1958 | Buchi | 415/17 |
| 3,355,878 | A | 12/1967 | Birmann | |
| 3,796,046 | A | 3/1974 | Klaue et al. | |
| 5,092,126 | A | 3/1992 | Yano | |
| 5,441,383 | A * | 8/1995 | Dale et al. | 415/158 |
| 5,758,500 | A * | 6/1998 | Sumser et al. | 60/602 |
| 5,855,117 | A * | 1/1999 | Sumser et al. | 60/602 |
| 6,216,459 | B1 * | 4/2001 | Daudel et al. | 60/605.2 |
| 6,269,643 | B1 * | 8/2001 | Schmidt et al. | 60/602 |
| 6,374,611 | B2 * | 4/2002 | Doring et al. | 60/605.1 |
| 6,536,214 | B2 * | 3/2003 | Finger et al. | 60/602 |
| 6,715,288 | B1 * | 4/2004 | Engels et al. | 60/602 |
| 6,928,816 | B2 * | 8/2005 | Leavesley | 60/602 |
| 7,010,918 | B2 * | 3/2006 | Ruess | 60/624 |
| 7,350,356 | B2 * | 4/2008 | Sumser et al. | 60/605.1 |
| 7,762,067 | B2 * | 7/2010 | Bouvier et al. | 60/602 |

FOREIGN PATENT DOCUMENTS

| | | |
|---|---|---|
| EP | 0093462 | 8/1983 |
| WO | WO 0073630 A1 * | 12/2000 |
| WO | 2004048755 | 11/2002 |

OTHER PUBLICATIONS

ISR/WO Honeywell.

* cited by examiner

*Primary Examiner* — Mary A Davis
(74) *Attorney, Agent, or Firm* — Alston & Bird LLP

(57) ABSTRACT

There is provided a variable flow turbocharger comprising a turbine chamber (22) within which a turbine (14) is mounted for rotation, an inlet passageway (20) arranged around the turbine chamber (22) for introducing exhaust gas into the turbine chamber (22), and an outlet passageway (24) extending from the turbine chamber (22) for discharging the exhaust gas. There is provided a movable wall member (**16*a*) whose position relative to the turbine (14) is adjustable to vary the geometry of the turbine chamber (22) at an outlet side of the turbine (14) close to the outlet passageway (24**).

15 Claims, 3 Drawing Sheets

VARIABLE FLOW TURBOCHARGER

BACKGROUND OF THE INVENTION

This invention relates to a variable flow turbocharger, and in particular the turbine stage of a turbocharger for an internal combustion engine.

Many internal combustion engines are equipped with turbochargers to improve engine efficiency. A turbocharger comprises a turbine and a compressor. In operation, the turbine captures high-temperature exhaust gas coming from the engine exhaust manifold. This exhaust gas then is used to drive the compressor which, in turn, pumps high pressure air into the engine inlet and combustion chambers. The effect of this process in an internal combustion engine is to increase the volume of air available for combustion. Because more air is available, a correspondingly greater amount of fuel can be consumed, or burnt, per cycle. In theory, the greater the fuel burnt, the greater the horsepower.

Typically, the turbine stage of a turbocharger comprises a turbine chamber within which the turbine is mounted, an inlet passageway arranged around the turbine chamber for introducing exhaust gas into the turbine chamber, and an outlet passageway extending from the turbine chamber for discharging the exhaust gas. The turbine chamber and the inlet and outlet passageways communicate such that incoming exhaust gas flows through the inlet passageway to the outlet passageway via the turbine chamber and rotates the turbine.

Under the current state of the art, it is known to vary the flow of exhaust gas in the turbine stage so that the power output of the turbine can be adjusted to suit varying engine demands. One common type of variable flow turbocharger is a wastegated (turbine bypass) turbocharger. Such turbochargers have a wastegate for bypassing exhaust gas around the turbine using a valve in the inlet passageway controlled by actuator means. Wastegated turbochargers are usually matched to give good performance at low engine speed with the valve closed. This improves transient response and reduces exhaust temperatures and emissions. As engine speed increases, the wastegate valve begins to open. This has the effect of increasing the flow capacity of the turbine stage and avoiding excess air delivery and turbine overspeed (see U.S. Pat. No. 4,643,640 for the basic concept of wastegated turbochargers).

In another type of variable flow turbocharger, a more complex method of turbocharging uses a turbine stage where the flow capacity of the turbine stage is adjusted by varying the geometry of a nozzle, the part of the inlet passageway which surrounds the turbine and directs the exhaust gas at the turbine. One common type of variable nozzle turbocharger has a set of swing or slide vanes which extend into the nozzle and which can be caused to vary in orientation so as to increase or decrease the effective cross-sectional area between the vanes. Decreasing the effective cross-sectional area between the vanes permits turbine speed to be increased by increasing the pressure differential across the turbine (see U.S. Pat. Nos. 4,643,640, 4,654,941 and 4,659,295 for the basic concept of swing vanes). In another type of variable nozzle turbocharger, one wall of the nozzle is defined by a moveable wall member, generally referred to as a nozzle ring. The position of the ring relative to a facing wall of the nozzle is adjustable to control the width of the nozzle. For instance, as gas flowing through the turbine decreases, the nozzle width may also be decreased to maintain gas velocity and optimize turbine output (see EP 1 226 580 A2 for the basic concept of a nozzle ring).

SUMMARY OF THE INVENTION

The invention intends to show a new path to vary gas flow in a turbine stage of a turbocharger.

According to the present invention, there is provided a variable flow turbocharger comprising a turbine chamber within which a turbine is mounted for rotation; an inlet passageway arranged around the turbine chamber for introducing exhaust gas into the turbine chamber; and an outlet passageway extending from the turbine chamber for discharging the exhaust gas. The variable flow turbocharger is characterized in that the geometry of the turbine chamber is defined by at least one movable wall member, including a movable wall member whose position relative to the turbine is adjustable to vary the geometry of the turbine chamber at an outlet side of the turbine close to the outlet passageway.

The turbocharger according the invention may have one of the following configurations:

A) The turbocharger further comprises a fixed wall defining a part of the turbine chamber at an inlet side of the turbine close to the inlet passageway.

B) The position of the at least one movable wall member is adjustable to vary the geometry of the turbine chamber at both the outlet side of the turbine and at an inlet side of the turbine close to the inlet passageway.

C) The at least one movable wall member further includes a movable wall member whose position relative to the turbine is adjustable to vary the geometry of the turbine chamber at an inlet side of the turbine close to the inlet passageway.

The geometry of the turbine chamber determines the flow capacity of the turbine by defining a turbine throat. The turbine throat is the sum of a number of areas bounded by a portion of the turbine wheel's hub diameter, the trailing edge of one turbine blade, a locus on the adjacent turbine blade defining the shortest distance across each blade passage, and the wall or wall member defining the turbine chamber. Usually, a turbine exhibits a controlled area reduction from the inlet side to the outlet side thereof, so that the turbine throat is located at a fixed position at the outlet side of the turbine close to the outlet passageway. If, however, the turbine chamber includes a movable wall member at the outlet side of the turbine, it is possible to vary the turbine throat and thus the flow capacity of the turbine. The closer the position of the movable wall member relative to the turbine is, the smaller is the turbine throat area and the more the flow capacity of the turbine is reduced. It follows that such a movable wall member can be construed as means for altering the geometry of the turbine chamber at the outlet side of the turbine to vary the flow capacity of the turbine.

The flow capacity of the turbine can be further increased by altering the geometry of the turbine chamber at not only the outlet side of the turbine (configuration A), but also the inlet side of the turbine. To this end, there may be provided a movable wall member for varying the geometry of the turbine chamber at both the outlet side and the inlet side of the turbine (configuration B), or there may be provided more than one movable wall member including one at the outlet side and another at the inlet side of the turbine (configuration C).

The turbine may have either a decreasing diameter or a substantially constant diameter from the inlet side to the outlet side thereof.

It is preferable that the at least one movable wall member matches the contour of the turbine. In this case, the movable wall member can be brought closer to the turbine so as to minimize the flow capacity of the turbine.

Preferably, the position of the at least one movable wall member distant from the turbine is selected such that the turbocharger has an increased flow capacity while avoiding excess air delivery to the engine and turbine overspeed. It is optional whether the movable wall member is moved between the position close to the turbine and the position distant from the turbine continuously or in a stepwise manner. If there is provided an additional movable wall member at the inlet side of the turbine, it is preferable that first the wall member at the outlet side of the turbine is moved away from the turbine to increase turbine throat and flow capacity, and then the wall member at the inlet side of the turbine is moved away from the turbine to further increase flow capacity.

There are no particular restrictions to the moving direction of the at least one movable wall member. In principle, it is possible to move the movable wall member in a direction radial to the turbine axis. In this case, the movable member is preferably segmented into several parts such that the diameter of the turbine chamber defined by the segmented wall member is increased when the parts of the wall member are moved away from the turbine.

In view of a more compact turbine stage, it is preferable that the at least one movable wall member is moved in an axial direction of the turbine in which the outlet passageway extends from the turbine chamber. In this case, it is preferable that the movable wall member is made of one piece.

When the at least one movable wall member is moved away from the turbine into the outlet passageway, at least part of the turbine may become uncovered. In this case, it might be necessary that the turbine stage comprises a fixed wall which surrounds the movable wall member when the movable wall member is in the position close to the turbine and which faces the uncovered part of the turbine when the movable wall member is in the position distant from the piston.

As discussed above, the present invention varies the flow capacity of the turbine stage by varying the geometry of the turbine chamber at the outlet side of the turbine. This concept is in contrast to the conventional turbocharger concepts discussed as background art. The conventional turbocharger concepts have in common that the exhaust gas flow is not varied by varying the geometry of the turbine chamber, but by varying the geometry of the inlet passageway. Varying the geometry of the inlet passageway does not make the flow capacity of the turbine variable. For this reason, there are inherent limitations on what can be achieved in terms of turbine stage performance. There are inevitable compromises in turbine design or selection, which are typically suboptimal for operation at low engine speed, as the turbine must not be limiting factor in determining flow capacity.

From the above it follows that the invention paves the way for varying gas flow in a turbine stage of a turbocharger without making compromises in turbine design or selection. The invention can be used on any known turbochargers of fixed geometry (e.g., wastegated turbochargers) or variable geometry (e.g., turbochargers having variable nozzle vanes or a variable nozzle ring). When used in conjunction with such conventional turbochargers, this invention allows for further improvements in performance by adding the variable flow capacity of the turbine, resulting in increased turbocharger performance over a wider operating range.

These and further objects, features and advantages of the invention will become apparent from the following detailed description of presently preferred embodiments taken in conjunction with the figures of the drawing.

DESCRIPTION OF PREFERRED EMBODIMENTS

Figure 1A:
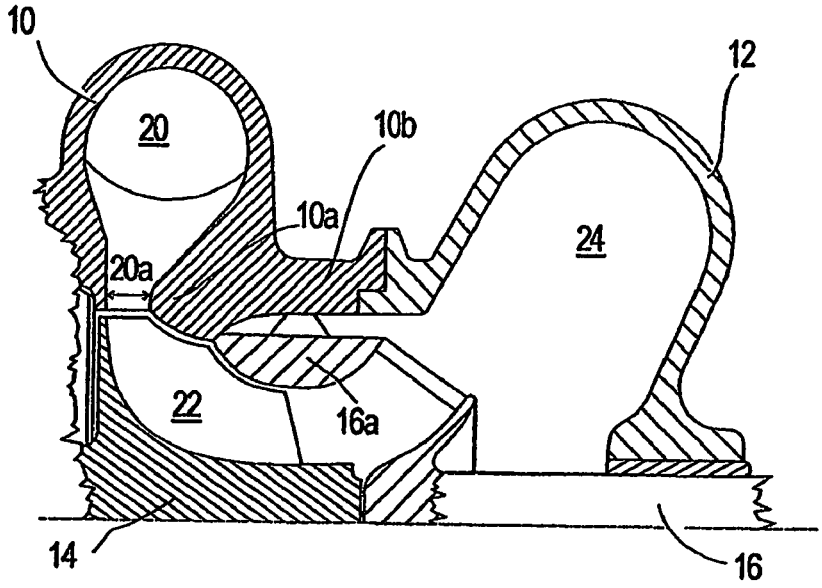
FIGS. 1A and 1B are partial sectional views of a turbine stage of a turbocharger according to first embodiment of the invention, wherein the turbine chamber is in a closed state (FIG. 1A) and an open state (FIG. 1B)
Figure 1B:
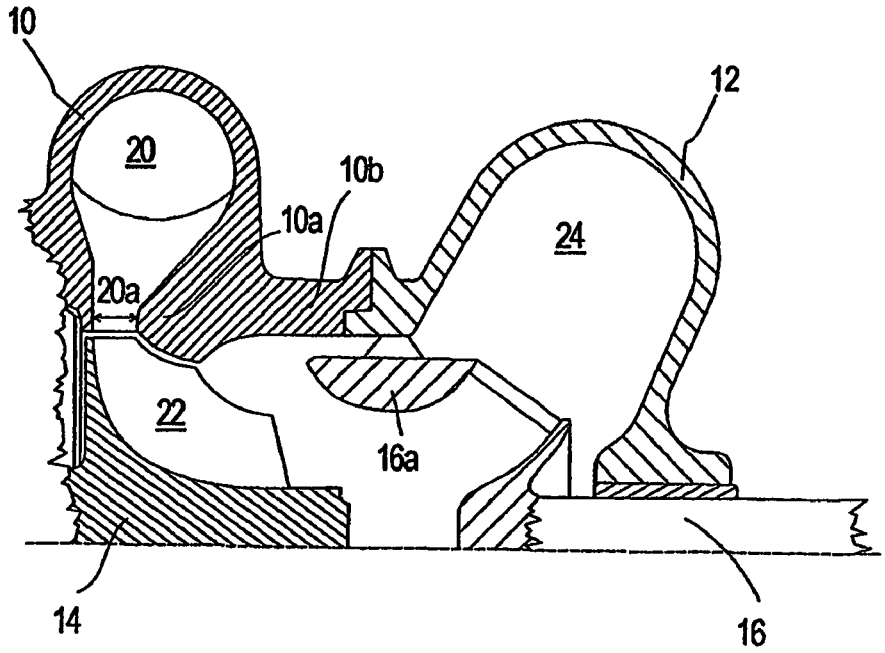
Figure 3A:
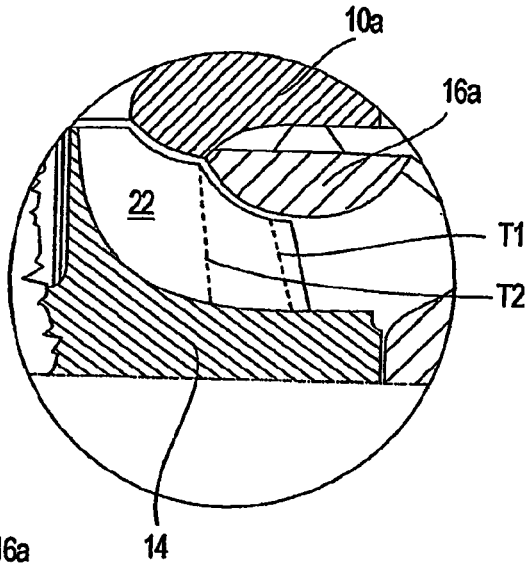
FIG. 3A is an enlarged section of the turbine chamber in the turbine stage of FIG. 1A, and FIGS. 3B and 3C show modifications of the turbine chamber and turbine shown in FIG. 3A.

Referring to the drawings, wherein like numerals of reference signs designate like elements throughout, FIGS. 1A and 1B show partial sectional views of a turbine stage of a turbocharger according to a first embodiment of the invention, and FIG. 3A shows an enlarged section of FIG. 1A.

The turbine stage comprises a two-piece turbine housing unit 10, 12 having a turbine chamber 22 within which a turbine 14 is mounted, an inlet passageway 20 of single scroll configuration arranged around the turbine chamber 22 for introducing exhaust gas into the turbine chamber 22, and an outlet passageway 24 extending from the turbine chamber 22 for discharging the exhaust gas. The turbine chamber 22 and the inlet and outlet passageways 20, 24 communicate such that incoming exhaust gas flows through the inlet passageway 20 to the outlet passageway 24 via the turbine chamber 22 and rotates the turbine 14.

The turbine housing piece 10 with the inlet passageway 20 has a protruding wall portion 10*a* which defines a nozzle 20*a* of fixed geometry for directing the exhaust gas at the turbine 14. The protruding wall portion 10*a* also defines part of the turbine chamber 22 at the inlet side of the turbine 14 close to the inlet passageway 20. The protruding wall portion 10*a* matches with the contour of the turbine 14 such that a gap between turbine 14 and wall portion 10*a* is reduced.

The turbine housing piece 12 that defines the outlet passageway 24 has an axial through bore in which a piston 16 is mounted for axial movement within the outlet passageway 24. The piston 16 is provided with a ring-shaped wall member 16*a* which is integrally moved with the piston 16.

When the movable wall member 16*a* is close to the turbine 14 (see FIG. 1A), the outer and inner ring walls of the movable wall member 16*a* conform with the contour of the turbine blades at the outlet side of the turbine 14 and the contour of the turbine wheel's 14 hub, respectively. In this state, the fixed wall portion 10*a* and the movable wall member 16*a* form a narrow turbine chamber 22 which forces the exhaust gas to flow along an arcuate path. As shown in FIG. 3A, the turbine throat, which determines the flow capacity of the turbine 14, is defined by the movable wall member 16*a* at a position T1 near the trailing edge of the turbine blades.

When the movable wall member 16*a* is distant from the turbine 14 (see FIG. 1B), the outlet side of the turbine 14 is uncovered or opened and, after passing the protruding wall portion 10*a*, the exhaust gas is allowed to spread out into a wide space defined by a wall portion 10*b* of the housing piece 10 which faces the uncovered part of the turbine 14 and which, as shown in FIG. 1A, surrounds the movable wall member 16*a* when the movable wall member 16*a* is in the position close to the turbine 14. The exhaust gas spreading into the wide space is discharged into the outlet passageway 24 by flowing through the passageway defined by the outer and inner ring walls of the movable wall member 16*a* and a gap between the outer ring wall of the movable wall member 16*a* and an inner surface of the housing unit 10, 12. As illustrated in FIG. 3A, the turbine throat is now located at a position T2 where the movable wall member 16*a* sat on the protruding wall portion 10*a* before it was moved away from the turbine 14. This turbine throat provides for an increased flow capacity of the turbine 14 as compared with the closed turbine chamber 22 shown in FIG. 1A.

The movable member 16*a* can be moved between the two extreme positions shown in FIGS. 1A and 1B continuously or in a stepwise manner to provide different turbine throat areas. By doing so, the exhaust gas can be varied and modulated between the characteristics of a turbine having a small flow capacity and a turbine having a larger flow capacity. When the movable wall member 16*a* is close to the turbine 14 (FIG. 1A), all of the exhaust gas goes through a passageway of small diameter or area, resulting in improved performance at low flow conditions. As the flow rate increases, the movable wall member 16*a* is moved away from the turbine 14, exposing a larger passageway to determine a larger flow capacity.

Figure 2A:
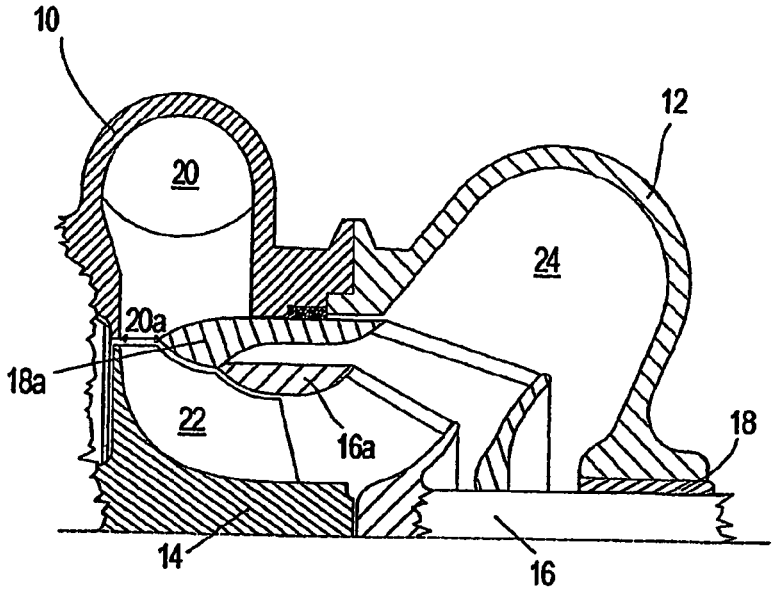
FIGS. 2A to 2C are partial sectional views of a turbine stage of a turbocharger according to second embodiment of the invention, wherein the turbine chamber is in a closed state (FIG. 2A), an open state (FIG. 2B), and a wide open state (FIG. 2C)
Figure 2B:
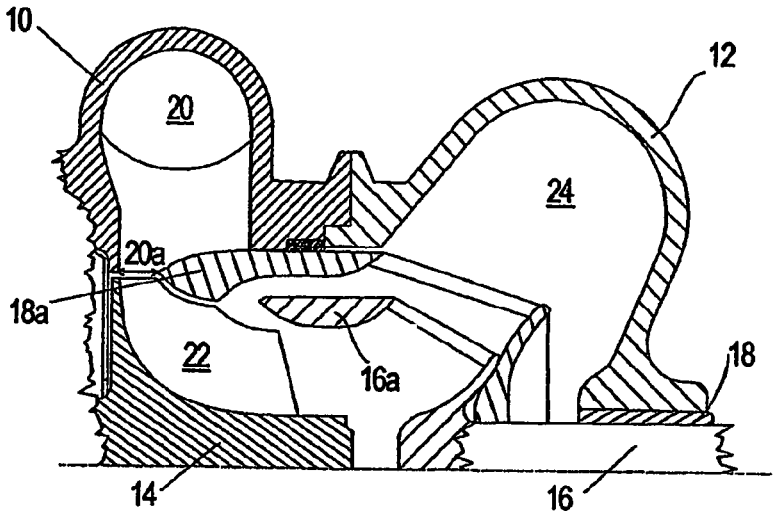
Figure 2C:
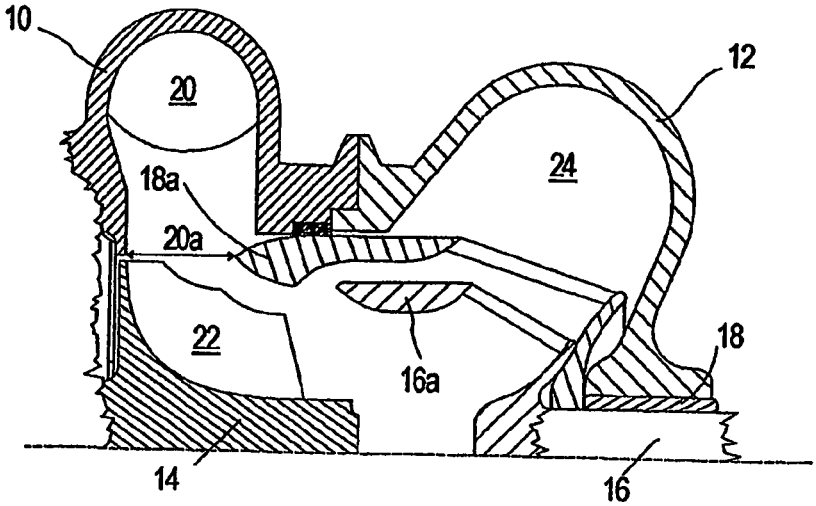

It is now referred to FIGS. 2A to 2C which show partial sectional views of a turbine stage of a turbocharger according to a second embodiment of the invention.

Similar to the turbine stage shown in FIGS. 1A and 1B, the turbine stage of the second embodiment comprises a two-piece turbine housing unit 10, 12 having a turbine chamber 22 within which a turbine 14 is mounted, an inlet passageway 20 arranged around the turbine chamber 22 for introducing exhaust gas into the turbine chamber 22, and an outlet passageway 24 extending from the turbine chamber 22 for discharging the exhaust gas.

The turbine housing piece 12 that defines the outlet passageway 24 has an axial through bore in which a first piston 16 is mounted for axial movement within the outlet passageway 14. The first piston 16 is provided with a first ring-shaped wall member 16*a* which is integrally moved with the first piston 16 and which has outer and inner ring walls conforming with the contour of the turbine blades at the outlet side of the turbine 14 and the contour of the turbine wheel's 14 hub, respectively.

In contrast to the turbine stage of the first embodiment, the nozzle 20*a* for directing the exhaust gas at the turbine 14 is not defined by a fixed wall portion of the turbine housing unit 10, 12, but by a nozzle tip of a second movable wall member 18*a*. The ring-shaped second movable wall member 18*a* is provided at a second piston 18 which is mounted in the axial through bore of the turbine housing piece 12 for axial movement within the outlet passageway 24. The outer ring wall of the second movable wall member 18*a* has a diameter larger than that of the first movable wall member 16*a*, so that the first movable wall member 16*a* is movable within the space defined by the outer and inner ring walls of the second movable wall member 18*a*.

The nozzle tip of the second movable wall member 18*a* conforms with the contour of the turbine blades at the inlet side of the turbine 14. When the first and second movable wall members 16*a* and 18*a* are close to the turbine 14 (see FIG. 2A), they form a narrow turbine chamber 22 which forces the exhaust gas to flow along an arcuate path. In this state, the turbine throat is defined by the first movable wall member 16*a* at a position near the trailing edge of the turbine blades.

When the first movable wall member 16*a* is moved away from the turbine 14 (see FIG. 2B), the outlet side of the turbine 14 is uncovered or opened, and the exhaust gas is allowed to spread out into the space defined by the outer ring wall of the second movable wall member 18*a*. The exhaust gas is discharged into the outlet passageway 24 by flowing through the passageway defined by the outer and inner ring walls of the first movable wall member 16*a* and a gap between the outer ring walls of the first and second movable wall members 16*a*, 18*a*. The turbine throat is now located at a position where the movable wall member 16*a* sat on the nozzle tip of the second movable wall member 18*a* before it was moved away from the turbine 14. The flow capacity of the turbine 14 is increased as compared with the closed turbine chamber shown in FIG. 2A.

In contrast to the first embodiment, it is possible to further increase the flow capacity of the turbine 14 by moving both the first and second movable wall members 16*a*, 18*a* away from the turbine 14 (FIG. 2C). By doing so, the nozzle tip of the second movable wall member 18*a* is moved to a position where it hardly obstructs the flow of incoming exhaust gas, thereby uncovering the inlet side of the turbine 14 and opening the turbine chamber 22 even wider. The exhaust gas flow increases until the turbine throat defined by the nozzle tip of the second movable wall member 18*a* will choke.

The movable members 16*a* and 18*a* can be moved between the extreme positions shown in FIGS. 2A to 2C continuously or in a stepwise manner to provide different turbine throat areas. By doing so, the exhaust gas can be varied and modulated between the characteristics of a turbine having a small flow capacity, a turbine having a larger flow capacity, and a turbine having a very large flow capacity. When the movable wall members 16*a*, 18*a* are close to the turbine 14 (FIG. 2A), all of the exhaust gas goes through a passageway of small diameter or area, resulting in improved performance at low flow conditions. As the flow rate increases, the first movable wall member 16*a* is moved away from the turbine 14, exposing a larger passageway to determine a larger flow capacity (FIG. 2B). As the flow rate further increases, the second movable wall member 18*a* is moved away from the turbine 14 to expose an even larger passageway and allow a portion of the exhaust flow to pass by the turbine without significantly influencing its rotation (FIG. 2C).

Figure 3B:
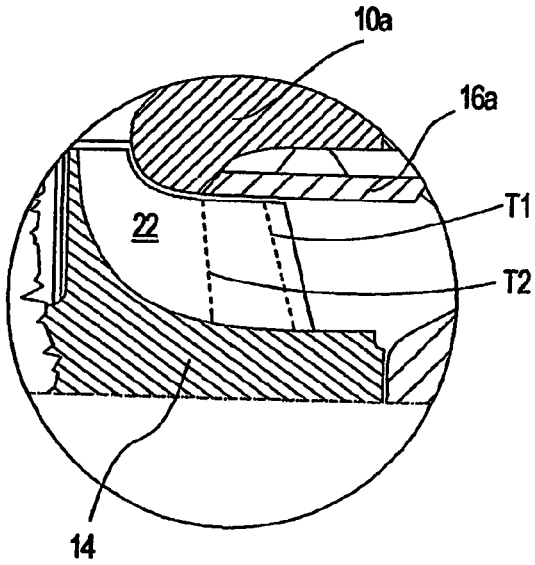
Figure 3C:
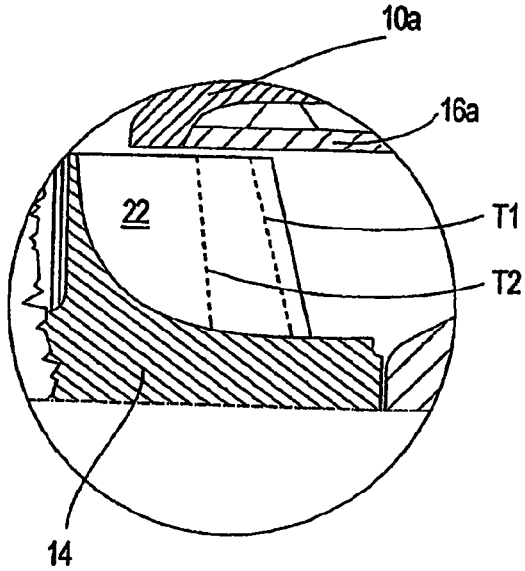

As best shown in FIG. 3A, the turbocharger of the first embodiment uses a turbine 14 having a diameter which gradually decreases from the inlet side to the outlet side. The same applies to the turbocharger of the second embodiment. However, the present invention is not limited to such a turbine, but it is basically applicable to all types of turbines. As shown in FIGS. 3B and 3C, a turbine 14 having a decreasing diameter at the inlet side and a constant diameter at the outlet side or a turbine 14 (a so-called "100% trim wheel") having a constant diameter from the inlet side to the outlet side may be used with modest modifications to the walls or wall members. As a matter of course, it is preferable that the movable wall members 16*a*, 18*a* and the fixed wall portions 10*a* that the define turbine chamber 22 are modified as well to conform with the respective shape of the turbine 14.

Further, the first and second movable wall members 16*a* and 18*a* may be made integral to provide a single wall member for varying the geometry of the turbine chamber 22 at both the outlet side and inlet side of the turbine 14 when it is moved away from the turbine 14. In this case, the turbine chamber 22 has a throat area that can be varied gradually between the characteristics of a turbine having a small flow capacity and a turbine having a very large flow capacity.

As discussed in the summary of the invention, this invention can be used on any known turbochargers of fixed or variable geometry, such as wastegated turbochargers or turbochargers having additional means for altering the geometry of the inlet passageway (e.g., a set of variable nozzle vanes or a variable nozzle ring).

Although the turbochargers of the first and second embodiment have a two-piece housing unit 10, 12, the housing unit can alternatively be manufactured in one or multiple pieces. Further, the inlet passageway 20 may have a twin or multiple configuration.

Apart from the above modifications of the preferred embodiments, various other modifications and alterations will be apparent to those skilled in the art. Accordingly, this description of the invention should be considered exemplary, not as limiting the scope of the invention set forth in the following claims.

The invention claimed is:

1. A variable-flow turbocharger comprising:

a turbine housing defining a turbine chamber having an internal diameter;

a turbine wheel mounted within the turbine chamber for rotation about an axis;

an inlet passageway for introducing exhaust gas into the turbine chamber;

an outlet passageway for discharging the exhaust gas from the turbine chamber;

wherein the turbine chamber is defined collectively by an outer wall and an inner wall, wherein the outer wall and the inner wall are overlapping with the outer wall located radially outward of the inner wall, and an open space is defined between a radially outer surface of the inner wall and a radially inner surface of the outer wall, the open space being in fluid communication with the outlet passageway;

at least the inner wall being axially movable relative to the turbine wheel from a closed position to an open position;

wherein in the closed position of the inner wall, the internal diameter of the turbine chamber at an outlet side of the turbine wheel is defined by the inner wall such that the turbine chamber has a relatively small internal diameter at the outlet side of the turbine wheel, and wherein the inner wall in the closed position engages a portion of the outer wall so as to close off the open space and prevent exhaust gas from flowing through the open space; and wherein in the open position of the inner wall, an axial spacing of the inner wall from the turbine wheel is increased such that the internal diameter of the turbine chamber at the outlet side of the turbine wheel is defined by the outer wall and is thereby increased, and wherein the inner wall in the open position uncovers the open space such that exhaust gas that has passed through the turbine wheel flows through the open space to the outlet passageway.

2. The variable-flow turbocharger of claim 1, wherein the inner wall is configured and arranged such that moving the inner wall from the closed position to the open position causes a size of a throat area of the turbine to be increased.

3. The variable-flow turbocharger of claim 1, wherein the outer wall is fixed.

4. The variable-flow turbocharger of claim 1, wherein the inner wall is movable continuously between the closed position and the open position.

5. The variable-flow turbocharger of claim 1, wherein the inner wall is movable in stepwise fashion between the closed position and the open position.

6. The variable-flow turbocharger of claim 1, wherein the outer wall is also axially movable relative to the turbine wheel from a closed position to an open position and, once the inner wall has been moved at least partway toward the open position of the inner wall, the outer wall is then movable toward the open position of the outer wall.

7. The variable-flow turbocharger of claim 6, wherein the outer and inner walls are arranged relative to each other such that motive force for moving the outer wall is provided by movement of the inner wall, and such that the outer wall remains stationary for part of a range of movement of the inner wall from the closed position to the open position of the inner wall, and when the inner wall reaches the end of said range, further movement of the inner wall causes the outer wall to move along with the inner wall.

8. The variable-flow turbocharger of claim 6, wherein the outer wall extends to a position adjacent the inlet passageway when the outer wall is in the closed position thereof.

9. The variable-flow turbocharger of claim 8, wherein the inlet passageway is defined in part by the outer wall such that when the outer wall is moved toward the open position thereof the inlet passageway becomes larger.

10. The variable-flow turbocharger of claim 1, wherein the outer and inner walls are shaped to conform with an outer contour of the turbine wheel.

11. The variable-flow turbocharger of claim 10, wherein the turbine wheel's outer contour has a decreasing diameter with respect to axial distance from an inlet side to the outlet side of the turbine wheel.

12. The variable-flow turbocharger of claim 10, wherein an axially extending portion of the turbine wheel's outer contour from an inlet side of the turbine wheel partway toward the outlet side has a decreasing diameter with respect to axial distance, and a remaining axially extending portion of the outer contour up to the outlet side has a constant diameter with respect to axial distance.

13. The variable-flow turbocharger of claim 10, wherein the turbine wheel's outer contour has a substantially constant diameter with respect to axial distance from an inlet side to the outlet side of the turbine wheel.

14. The variable-flow turbocharger of claim 1, wherein the outer wall is fixed and is arranged to face an uncovered part of the turbine wheel that is covered by the inner wall when the inner wall is in the closed position and that is uncovered when the inner wall is moved to a position distant from the turbine wheel.

15. The variable-flow turbocharger of claim 1, wherein the inlet passageway is defined between the outer wall and an opposite fixed wall of the turbine housing, and the inlet passageway remains unchanged in size when the inner wall is moved from the closed position to the open position.

* * * * *